United States Patent [19]

Ducharme

[11] Patent Number: 5,062,244

[45] Date of Patent: Nov. 5, 1991

[54] INSULATING INSERT FOR THE CORES OF BUILDING BLOCKS

[76] Inventor: Edgar R. Ducharme, 28 Shady Brook La., West Springfield, Mass. 01089

[21] Appl. No.: 664,091

[22] Filed: Mar. 4, 1991

[51] Int. Cl.[5] ..... E04B 1/62

[52] U.S. Cl. ..... 52/98; 52/309.12; 52/405

[58] Field of Search ..... 52/309.12, 396, 404, 52/405, 406, 407, 98, 309.4, 309.6, 309.14, 309.17

[56] References Cited

U.S. PATENT DOCUMENTS

| | | | |
|---|---|---|---|
| 3,546,833 | 12/1970 | Perreton . | |
| 3,885,363 | 5/1975 | Whittey . | |
| 4,193,241 | 3/1980 | Jensen et al. | 52/405 |
| 4,631,885 | 12/1986 | Iannarelli . | |
| 4,748,782 | 6/1988 | Johnson et al. | 52/405 |
| 4,887,405 | 12/1989 | Nickerson . | |

*Primary Examiner*—Richard E. Chilcot, Jr.
*Assistant Examiner*—Robert Canfield
*Attorney, Agent, or Firm*—Donald S. Holland

[57] ABSTRACT

A preformed insulating insert is disclosed, that fits into the cores of masonry building blocks. In the preferred embodiment, the insert is generally rectangular having an upper and lower face, front and back surfaces and sidewalls. Elongated internal cavities emanate downwardly from the upper face toward the lower face and compression slots extend upwardly from the lower face toward the upper face. The elongated interanl cavities and the compression slots terminate at or beyond a common horizontal plane within the body of the insert, thereby providing lateral compression over the full height of the insert while maintaining optimum thermal resistance.

9 Claims, 2 Drawing Sheets

INSULATING INSERT FOR THE CORES OF BUILDING BLOCKS

BACKGROUND OF THE INVENTION

This invention relates to preformed inserts that fit into the hollow cavities or cores of masonry building blocks, for insulation.

Various attempts have been made to insulate masonry building blocks. Included among these attempts is the manufacture of STYROFOAM ® inserts that are slidable into masonry block cavities of various sizes and shapes. These foam inserts are intended to prevent the transfer of heat or cold from inexpensively constructed buildings (e.g., factories) where the buildings' inner walls are actually the "inside" face(s) of the masonry block(s). In those buildings, no inside paneling or sheetrock is attached, so the blocks have to be well insulated to prevent a large "heat" transfer.

U.S. Pat. No. 4,887,405 to Nickerson discloses various embodiments of that type of foam insert—all of which are rectangular blocks with external compression slots. In one embodiment, these external slots extend almost the entire height of the insert, being alternatively located on the front and back surfaces. The disclosed insert does not allow for lateral compression over its full height; and unless the slots are completely compressed and undamaged upon insertion, heat transfer channels, in direct contact with the air and with the conductive masonry block, are formed thereby diminishing the insulating properties of the insert.

A second embodiment, in Nickerson, also discloses external compression slots, but with interfitting edge portions which reportedly seal the inner channel of the slot. This embodiment also does not allow for lateral compression over the full height of the insert. In addition, such interfitting edge portions are extremely difficult to mold and therefore make this insert less commercially attractive.

In another, unpatented, Nickerson embodiment (not shown), external compression slots, alternatively located on the front and back surfaces, extend the entire height of the insert. While providing lateral compression over the full height of the insert, this embodiment, when fully compressed, provides open-ended, vertical internal channels. These channels act as open chimneys that allow for the uninterrupted transfer of heat via convection.

Usually, the industry practice is to apply mortar over the masonry block, after a foam insert (like Nickerson) is slid into place and the block inverted. The unpatented Nickerson insert allows the mortar to creep into the external slots, and both the patented and unpatented Nickerson inserts allow for the mortar to creep into the sides. This creates so-called "mortar" fingers that act as a thermal bridge with the adjacent block, to accelerate heat transfer via conduction.

Accordingly, it is a general object of the present invention to provide an improved insert that overcomes the deficiencies of the prior art and which achieves lateral compression over the full height of the insert while maintaining optimum thermal resistance.

It is a more specific object to provide a slightly oversized insert containing a plurality of elongated internal cavities and compression slots that emanate from the opposite faces of the insert and which operate collectively to permit lateral compression over the full height of the insert.

It is another object to provide an insert having compression slots designed such that, upon compression, the slots are effectively sealed to prevent any heat loss.

It is yet another object to provide an insert that upon compression is devoid of any open-ended channels in direct contact with the block cavity walls or with any exposed area that would permit heat transfer.

SUMMARY OF THE INVENTION

The present invention is a preformed insulating insert for the cores of building blocks. The preferred embodiment comprises a generally rectangular body having an upper and lower face, front and back surfaces and sidewalls, a plurality of elongated internal cavities extending downwardly from the upper face toward the lower face and a plurality of compression slots extending upwardly from the lower face toward the upper face and outwardly from the front surface to the back surface. The elongated internal cavities and the compression slots terminate at or beyond a common horizontal plane within the body of the insert, thereby enabling lateral compression over the full height of the insert and thereby enabling the insert to conform to cores of different sizes and shapes of building blocks. The inventive insert effectively maintains optimum thermal resistance.

The above and other objects and advantages of this invention will become more readily apparent when the following description is read in conjunction with the accompanying drawings.

DETAILED DESCRIPTION OF THE PREFERRED EMBODIMENT

Figure 1:
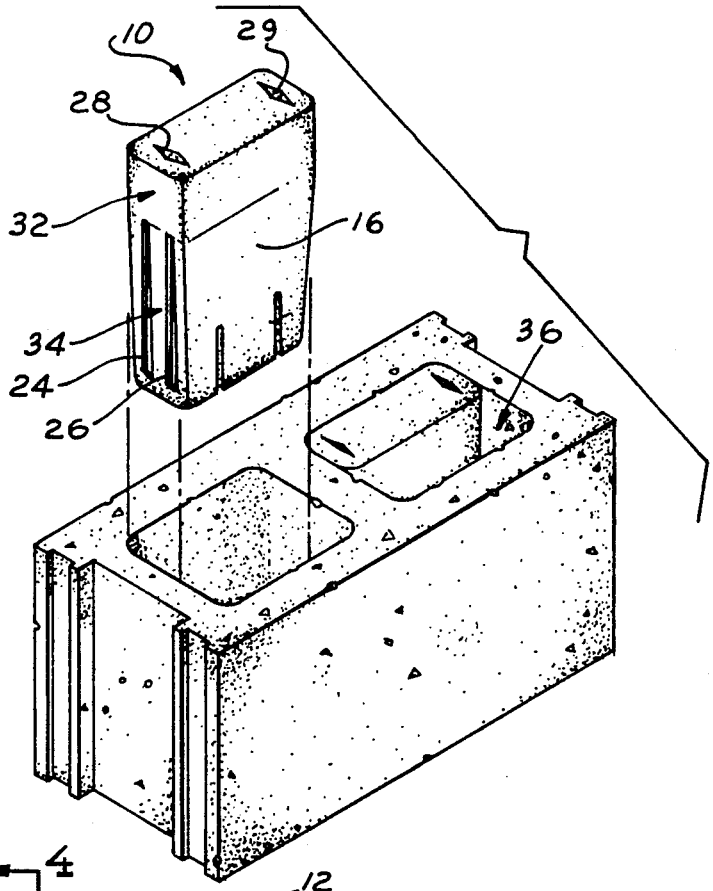
FIG. 1 is a top perspective view illustrating a masonry building block having a pair of similar cavities or cores with an insulating insert a above one of the cavities for downward entry into the cavity and a similar insert disposed within the other cavity.

Referring to the drawings in detail, a preferred embodiment of the inventive insulating insert is shown and designated by the reference numeral 10. It is marketed under the trademark, UNITHERM TM, by Korfil, Inc., of Brookfield, MA.

Figure 2:
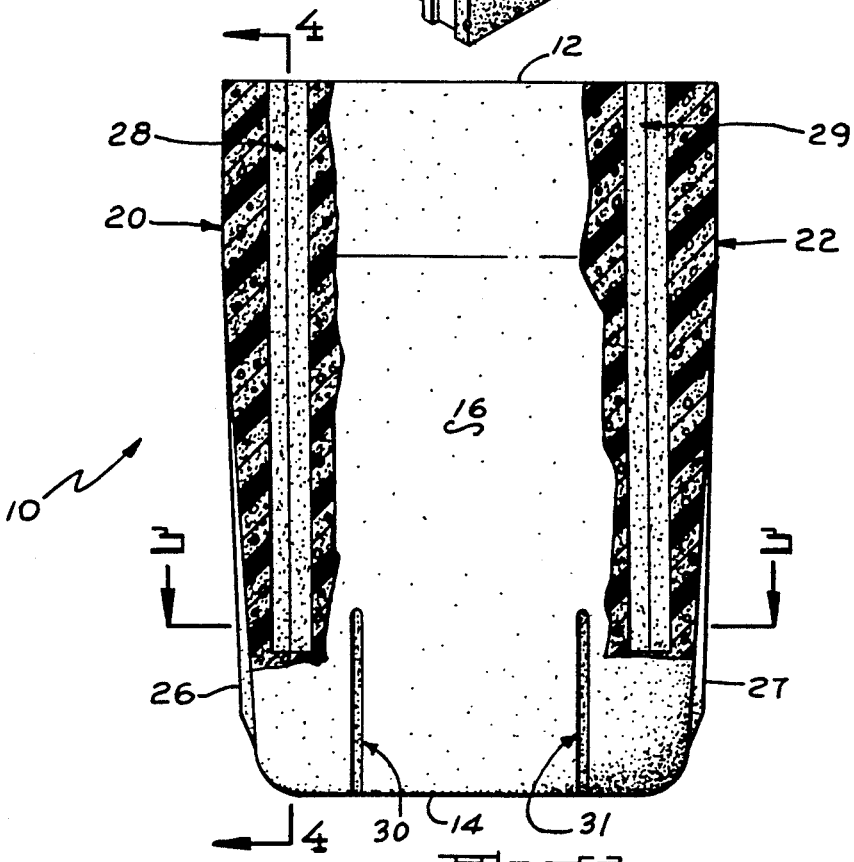
FIG. 2 is a front elevational view of a FIG. 1 insert, with portions broken away to show two diamond-shaped elongated internal cavities disposed within the insert.
Figure 3:
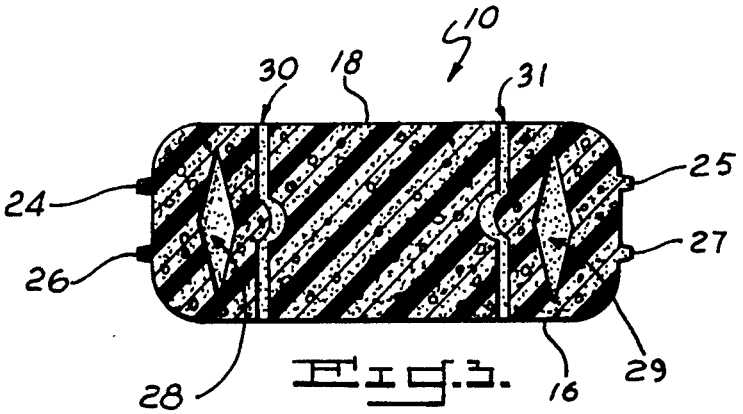
FIG. 3 is a horizontal cross section taken along line 3—3 of FIG. 2, showing the relationship between the elongated internal cavities and the tongue-and-groove compression slots.
Figure 4:
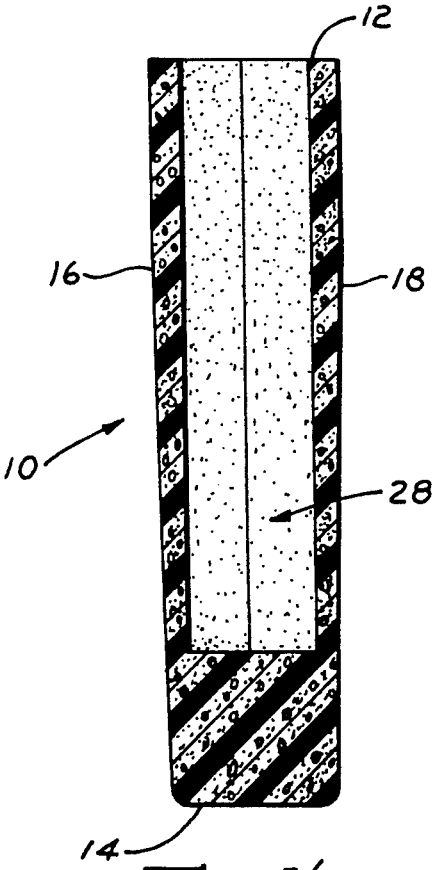
FIG. 4 is a vertical cross section taken along line 4—4 of FIG. 2, showing one of the diamond-shaped elongated cavities.

The inventive insert 10 is molded from polystyrene or other similar synthetic resins. As best shown in FIGS. 1-3, it is basically comprised of an upper face 12, a lower face 14, a front surface 16, a back surface 18, sidewalls 20 and 22, and wing members 24, 25, 26 and 27. Elongated internal cavities 28, 29 extend downwardly from the upper face 12 toward the lower face 14; and compression slots 30, 31 extend upwardly from the lower face 14 towards the upper face 12 and outwardly from the front surface 16 to the back surface 18. As best shown in FIGS. 2 and 3, the elongated internal cavities 28, 29 terminate at a distance greater than one-half the height of the insert 10 and the compression slots 30, 31 terminate at a distance less than one-half the height of the insert, with the two slots being located between the two cavities in the body of the insert. This configuration allows for lateral compression over the full height of the insert, thereby enabling the insert to conform to the cores of different sizes and shapes of building blocks.

As shown in FIGS. 1 and 3, the elongated internal cavities 28, 29 are diamond shaped. Upon compression of the insert during insertion into a block, these diamond-shaped cavities will collapse in upon themselves but will not break. By collapsing, the dead-air void space is reduced and the insulation value of the insert increased.

As best shown in FIG. 3, the compression slots 30, 31 are tongue-and-groove configured compression slots. Upon compression, these slots are effectively sealed to prevent heat loss through the passages once defined by the non-compressed slots.

Figure 5:
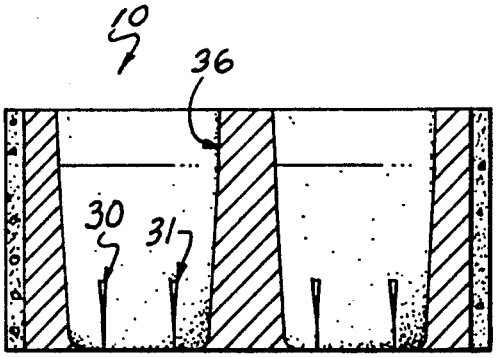
FIG. 5 is a vertical cross section of a masonry building block having bevel-type or tapered cavities and having insulating inserts disposed within the cavities.

The preferred insert 10 has two identical sidewalls 20, 22. Each has an upper portion (e.g., 32) and a lower portion (e.g., 34). The lower portions (e.g., 34) taper inwardly towards the lower face 14. Attached to the lower portion (e.g., 34) of each sidewall 20, 22 is at least one frangible wing member (24, 25, 26 or 27), which enables the insert to conform to straight (non-tapered) cores. Upon insertion into a straight core, the wing members become flush against the core walls and serve to eliminate any flow path between the core walls and the insert. Upon insertion into a bevel-type or tapered core 36, as shown in FIG. 5, the wing members are stripped away and the tapered lower portions (e.g., 34) of the sidewalls of the insert are seated snugly in the tapered portion of the core.

The preferred dimensions for the inserts (slightly oversized than the cores in which they are inserted) are approximately 7½ inches high, 2 inches thick, and either from 4 12/16 to 5 9/16 inches at its upper surface and from 4 to 4 13/16 inches at its lower surface, from 5 2/16 to 5 14/16 inches at its upper surface and from 4 6/16 to 5 2/16 inches at its lower surface or from 5 6/16 to 6 2/16 inches at its upper surface and from 5 to 5 6/16 inches at its lower surface. The variation in the inserts length allows for their adaptability to both "standard" and "breaker unit" type 6-inch, 8-inch, 10-inch and 12-inch blocks.

To place the inventive insert 10 within masonry blocks of either standard (i.e., rectangular), bubble sash or pear-shaped cores with walls the are either tapered or straight, the block is inverted, and the insert fitted into the core opening with the lower face !4 end disposed downward. The masonry block is then normally flipped over for use in its building function.

Once in position within the core of the masonry building block, the compression slots 28, 29 of the inventive insert are effectively sealed. This prevents any grout or mortar from entering the insert, thereby increasing its insulation value.

It should be understood by those skilled in the art that obvious structural modifications can be made without departing from the spirit of the invention. For example, the specific shape of the outer surface of the insert and the specific shape of the elongated internal cavities, as detailed and described, should not be considered as limiting. Accordingly, reference should be made primarily to the accompanying claims, rather than the foregoing specification, to determine the scope of the invention.

Having thus described the invention, what is claimed is:

1. An insulating insert for the cores of building blocks, said insert comprising a generally rectangular body having an upper and lower face, front and back surfaces, and sidewalls, said insert having a plurality of elongated internal cavities extending downwardly from said upper face toward said lower face and having a plurality of compression slots extending upwardly from said lower face toward said upper face and extending outwardly from said front surface to said back surface, such that said elongated internal cavities and said compression slots terminate at or beyond a common horizontal plane within said body of said insert, thereby enabling lateral compression over the full height of said insert and thereby enabling said insert to conform to the cores of different sizes and shapes of building blocks.

2. The insulating insert of claim 1 wherein said sidewalls of said insert are comprised of upper and lower portions, said lower portions being tapered inwardly toward said lower face and which have at least one frangible wing-like member emanating therefrom, thereby enabling said insert to conform to building blocks having either straight or tapered cores, said wing members being stripped away upon insertion into a tapered core but said wing members being maintained upon insertion into a straight core.

3. The insulating insert of claim 1 wherein said compression slots are tongue-and-groove configured compression slots and wherein said elongated internal cavities are diamond-shaped elongated internal cavities.

4. The insulating insert of claim 1 wherein said elongated internal cavities terminate at a distance greater than one-half of the height of said insert and said compression slots terminate at a distance less than one-half the height of said insert.

5. An insulating insert for the cores of building blocks, said insert comprising a generally rectangular body having an upper and lower face, front and back surfaces and sidewalls, said insert having two diamond-shaped elongated internal cavities extending downwardly from said upper face toward said lower face and having two tongue-and-groove configured compression slots extending upwardly from said lower face toward said upper face and extending outwardly from said front surface to said back surface, such that said two diamond-shaped elongated internal cavities and said two tongue-and-groove configured compression slots terminate at or beyond a common horizontal plane within said body of said insert thereby enabling lateral compression over the full height of said insert and thereby enabling said insert to conform to the cores of different sizes and shapes of building blocks.

6. The insulating insert of claim 5 wherein said sidewalls of said insert are comprised of upper and lower portions, said lower portions being tapered inwardly toward said lower face and which have at least one frangible wing-like member emanating therefrom, thereby enabling said insert to conform to building blocks having either straight or tapered cores, said wing members being stripped away upon insertion into a tapered core but said wing members being maintained upon insertion into a straight core.

7. The insulating insert of claim 5 wherein said two diamond-shaped elongated internal cavities terminate at a distance greater than one-half of the height of said insert and said two tongue-and-groove configured compression slots terminate at a distance less than one-half the height of said insert, and wherein said two tongue-and-groove configured compression slots are located between said two diamond-shaped elongated internal cavities in said body of said insert.

8. An insulating insert for the cores of building blocks, said insert comprising a generally rectangular body having an upper and lower face, front and back surfaces and sidewalls, said upper and lower faces being positioned on equidistant planes, said front and back surfaces being positioned perpendicularly to said upper and lower faces and said side walls being positioned perpendicularly to said upper and lower faces and to said front and back surfaces, said side walls being comprised of upper and lower portions, said lower portions being tapered inwardly toward said lower face and which have at least one frangible wing-like member emanating therefrom, said insert having two diamond-shaped elongated internal cavities extending downwardly from said upper face toward said lower face and having two tongue-and-groove configured compression slots extending upwardly from said lower face toward said upper face and extending outwardly from said front surface to said back surface, such that said two diamond-shaped elongated internal cavities and said two tongue-and-groove configured compression slots terminate at or beyond a common horizontal plane within said body of said insert thereby enabling lateral compression over the full height of said insert and thereby enabling said insert to conform to both straight and tapered cores of different sizes and shapes of building blocks.

9. The insulating insert of claim 8 wherein said two diamond-shaped elongated internal cavities terminate at a distance greater than one-half of the height of said insert and said two tongue-and-groove configured compression slots terminate at a distance less than one-half the height of said insert and wherein said two tongue-and-groove configured compression slots are located between said two diamond-shaped elongated internal cavities in said body of said insert.

* * * * *